US006537960B1

(12) United States Patent
Ruhr et al.

(10) Patent No.: US 6,537,960 B1
(45) Date of Patent: Mar. 25, 2003

(54) SURFACTANT BLEND FOR USE IN HIGHLY ALKALINE COMPOSITIONS

(75) Inventors: Richard O. Ruhr, Buffalo, MN (US); Nathan D. Peitersen, Eagan, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/940,345

(22) Filed: Aug. 27, 2001

(51) Int. Cl.[7] ..... C11D 1/75; C11D 1/72; C11D 3/43; C11D 3/44

(52) U.S. Cl. ..... 510/423; 510/195; 510/197; 510/199; 510/218; 510/235; 510/238; 510/433; 510/434; 510/435; 510/470; 510/503; 510/506

(58) Field of Search ..... 510/195, 197, 510/199, 218, 235, 238, 423, 433, 434, 435, 470, 503, 506

(56) References Cited

U.S. PATENT DOCUMENTS

| | | | | |
|---|---|---|---|---|
| 3,956,401 | A | 5/1976 | Scardera et al. | 260/615 B |
| 4,230,592 | A | 10/1980 | Miller et al. | 510/422 |
| 4,240,921 | A | 12/1980 | Kaniecki | 252/256 |
| H171 | H | 12/1986 | McDaniel et al. | 252/174 |
| H468 | H | 5/1988 | Malik et al. | 252/542 |
| 5,109,127 | A | 4/1992 | Sekiguchi et al. | 536/115 |
| 5,190,747 | A | 3/1993 | Sekiguchi et al. | 424/56 |
| 5,203,366 | A | 4/1993 | Czeck et al. | 137/3 |
| 5,376,298 | A | 12/1994 | Michael | 510/238 |
| 5,656,683 | A | 8/1997 | Ruggiero et al. | 524/100 |
| 5,681,949 | A | 10/1997 | Johansson et al. | 536/23.1 |
| 5,759,979 | A | 6/1998 | Schmid et al. | 510/237 |
| 5,770,555 | A | 6/1998 | Weinstein | 510/424 |
| 5,928,993 | A | 7/1999 | Johansson | 504/365 |
| H1818 | H | 11/1999 | Potgieter et al. | 510/422 |
| 5,981,455 | A | 11/1999 | Carrie et al. | 510/218 |
| 5,990,065 | A * | 11/1999 | Vinson et al. | 510/237 |
| 6,015,839 | A | 1/2000 | Milius | 516/134 |
| 6,133,222 | A * | 10/2000 | Vinson et al. | 510/428 |
| 6,194,371 | B1 | 2/2001 | Donovan et al. | 510/396 |
| 6,204,234 | B1 * | 3/2001 | Herbots et al. | 510/321 |
| 6,294,511 | B1 * | 9/2001 | Argo et al. | 510/238 |

FOREIGN PATENT DOCUMENTS

| | | | |
|---|---|---|---|
| WO | WO 91/08281 | * | 6/1991 |
| WO | 93/16156 | | 8/1993 |
| WO | 94/05769 | | 3/1994 |
| WO | 96/00316 | | 1/1996 |

* cited by examiner

*Primary Examiner*—Gregory DelCotto
(74) *Attorney, Agent, or Firm*—Vidas, Arrett & Steinkraus P.A.

(57) ABSTRACT

A low foaming surfactant blend for use in highly alkaline conditions including at least one $C_3$ to $C_{10}$ alkyl polyglucoside, at least one amine oxide, at least one polycarboxylated alcohol alkoxylate, and at least one alcohol alkoxylate. The blend may combined with other optional ingredients including a source of alkalinity, water conditioning agents, a source of chlorine, silicates, solvents, high foam amine oxides, other surfactants, and so forth to form a cleaning concentrate. The concentrate may be diluted to use solutions with water.

35 Claims, 1 Drawing Sheet

Surface Tension Comparisons Low Foam Surfactant Blends in a High Alkaline Solution at 140 °F
Surface Tension (mN / m)
40
39
38
37
36
35
34
33
32
31
30
29
28
27
26
25
0.0%
0.5%
1.0%
1.5%
2.0%
2.5%
3.0%
3.5%
Concentration of 2% Low Foam Surfactant Blend in a High Alkaline Soultion
Example 1
Comparitive A

SURFACTANT BLEND FOR USE IN HIGHLY ALKALINE COMPOSITIONS

FIELD OF THE INVENTION

The present invention relates to an aqueous surfactant blend including at least one $C_3$ to $C_{10}$ alkyl polyglucoside, at least one amine oxide, at least one polycarboxylated alcohol alkoxylate, and at least one alcohol alkoxylate. The composition is particularly useful in alkaline cleaning compositions that provide low foaming, and improved solubility, wetting, cleaning and chlorine stability.

BACKGROUND OF THE INVENTION

Many dairies, breweries, beverage plants, canneries, and other food processing operations use highly alkaline cleaning and sanitizing solutions for hard surface cleaning and clean-in-place applications. Concentrated alkaline solutions, typically about 50% sodium hydroxide, are diluted to desired use concentrations.

Substantial attention has been directed to concentrate materials having increased active content that can be manufactured as stable liquids. A need has existed to increase the active concentration of detergent components in order to provide improved efficacy and performance. However, in these highly alkaline environments, it can be extremely difficult to form stable concentrated aqueous solutions with a high active content. Furthermore, the use of higher performing surfactants make it even more difficult to form stable concentrated aqueous solutions without phase separation, and typically, the more detersive the surfactant, the harder it is to form a stable concentrated aqueous solution.

Thus, a need remains for stable, highly concentrated cleaning solutions which can be formed in a highly alkaline environment, that are stable upon storage, that provide satisfactory cleaning, are low foaming and also are chlorine stable.

U.S. Pat. No. 4,240,921 describes an aqueous cleaning concentrate containing alkali metal hydroxide, at least two nonionic surfactants and an alkyl glucoside or alkoxylated glycidyl ether. The concentrate can be diluted with water or additional aqueous alkali metal hydroxide to provide a low foaming composition useful for washing bottles and other food and beverage containers.

The present invention seeks to overcome the problems of the prior art by providing an improved, stable alkali-soluble cleaning compositions that have good stability in high alkalinity, good cleaning, are low foaming, and that are also chlorine stable.

SUMMARY OF THE INVENTION

The present invention provides a surfactant blend that is useful in highly alkaline solutions, that has good stability, good cleaning performance, is chlorine stable, and which has a performance level that exceeds that of the individual components.

More specifically, the present invention relates to a surfactant blend which includes at least one $C_3$ to $C_{10}$ alkyl polyglucoside, at least one amine oxide, at least one polycarboxylated alcohol alkoxylate, and at least one alcohol alkoxylate.

Suitably, the surfactant blend includes about 10 to about 50 wt-% of the alkyl polyglucoside, about 1 to about 15 wt-% of the amine oxide, about 1 to about 30 wt-% of the polycarboxylated alcohol alkoxylate, about 1 to about 10 wt-% of the alcohol alkoxylate, and about 0 to about 25 wt-% water.

More suitably, the surfactant blend includes about about 10 wt-% to about 45 wt-% of said at least one alkyl polyglucoside, about 3 wt-% to about 15 wt-% of said at least one amine oxide, about 3 wt-% to about 25 wt-% of at least one polycarboxylated alcohol alkoxylate, and about 3 wt-% to about 6 wt-% of said at least one alcohol ethoxylate.

The surfactant blend may then be combined with an alkaline solution of about 25% to about 50% active ingredient such as sodium hydroxide solution, water conditioning agents, bleaches, silicates, solvents, high foam amine oxides, and so forth to form a chemical composition useful for cleaning purposes, for instance. The surfactant blend has been found to have excellent stability in both highly alkaline and in chlorinated environments.

The resultant cleaning concentrates are easily diluted with water at the time of use to the desired use concentrations and are thus made readily useable as cleaning compositions. Typical use dilutions are at a ratio of about 1:10 to 1:100, and suitably about 1:30. Expressed as a percentage a typical use dilution may be about 3.5%, or in gallons it may be about 4.5 oz/gal. As diluted use solutions, these compositions are useful for effective soil removal in laundry, ware washing, clean-in-place (CIP) applications including dairy, brewery, cannery, beverage, and other food processing operations.

The materials are phase stable and have viscosities that make them readily usable in larger scale industrial and institutional applications. The compositions provide improved stability, improved wettability, and improved or enhanced soil removal properties because of high alkaline and surfactant contact.

DETAILED DESCRIPTIONS OF THE PREFERRED EMBODIMENTS

Figure 1:
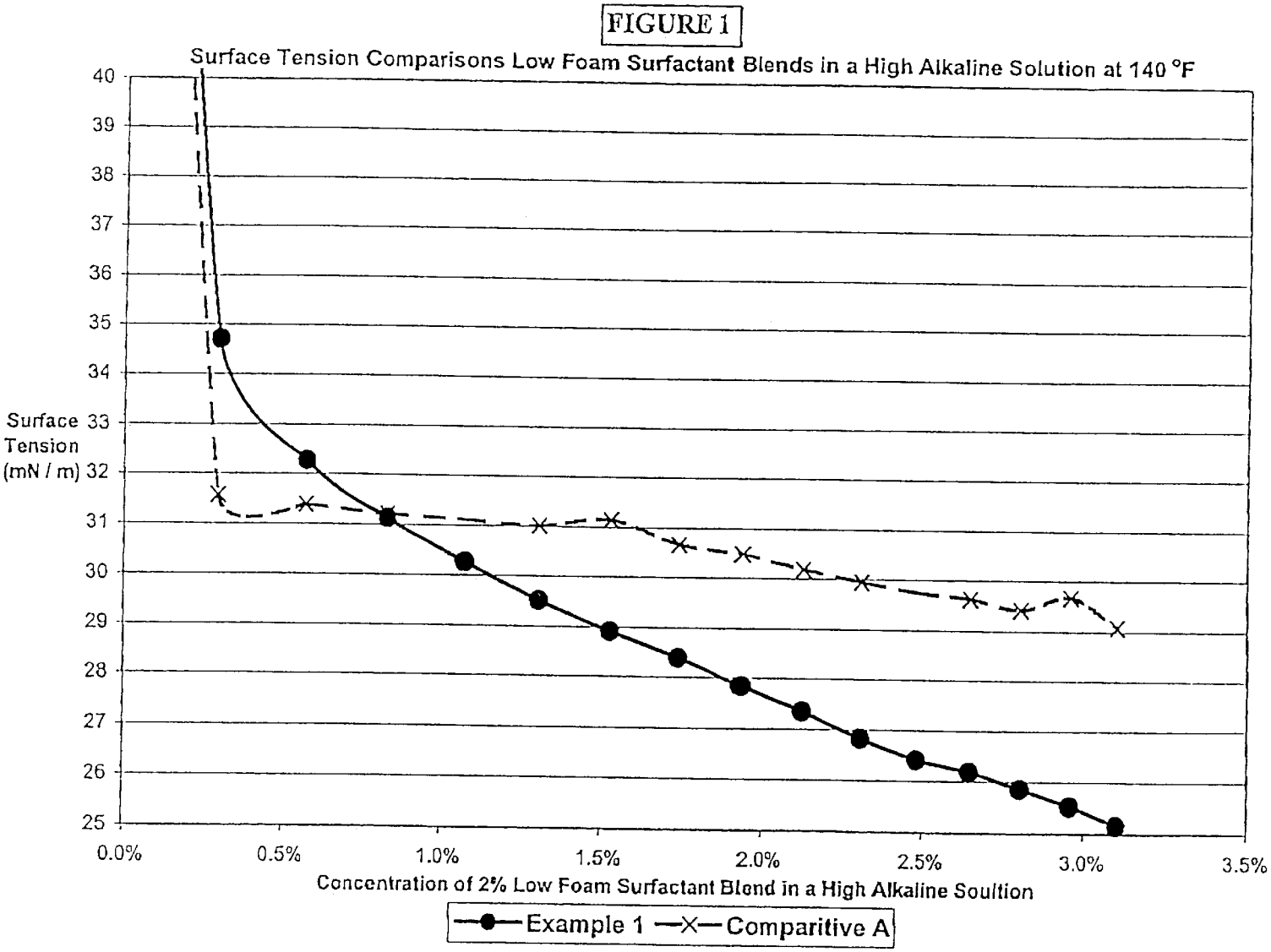
FIG. 1 illustrates the effect of using the surfactant blend of the present invention on the surface tension of a caustic solution compared to comparative example A which utilizes RHODATERGE® BCC, a commercially available wetting agent/antifoam blend of amphoteric surfactants.

The compositions of the present invention include novel surfactant blends for use in highly alkaline and/or chlorinated environments.

The Surfactant Blend

The surfactant blend includes an amine oxide nonionic detersive surfactant, a polycarboxylated alcohol alkoxylate surfactant, an alcohol alkoxylate surfactant, and an alkyl polyglucoside surfactant hydrotrope. This surfactant blend may then be mixed with other components including caustic solutions, bleaches, water conditioning agents, and so forth.

The Surfactants of the Surfactant Blend

The amine oxides useful herein are nonionic detersive surfactants. They may function as both a coupler, and as a foam control agent. Suitable amine oxides include, but are not limited to, those compounds having the formula $R_3(OR_4)_xN_0(R_5)_2$ wherein $R_3$ is selected from an alkyl, hydroxyalkyl, acylamidopropoyl and alkyl phenyl group, or mixtures thereof, containing from 8 to 26 carbon atoms; $R_4$ is an alkylene or hydroxyalkylene group containing from 2 to 3 carbon atoms, or mixtures thereof; x is from 0 to 5, preferably from 0 to 3; and each $R_5$ is an alkyl or hydroxyalkyl group containing from 1 to 3, or a polyethylene oxide group containing from 1 to 3 ethylene oxide groups.

More specifically, the amine oxides suitable for use herein include, but are not limited to, $C_{10}$–$C_{18}$ alkyl dimethylamine oxides, $C_{10-18}$ acylamido alkyl dimethylamine oxides, acylamido alkyl dimethylamine oxide, trialkyl amine oxides and trialkyl phosphine oxides wherein one alkyl group ranges from 10 to 18 carbon atoms and two alkyl groups range from 1 to 3 carbon atoms wherein the alkyl groups can contain hydroxy substituents including dodecyl di(2-hydroxyethyl)amine oxide and tetradecyl dimethyl phosphine oxide, and so forth. The amine oxide is useful from about 1 wt-% to about 15 wt-% of the surfactant blend, and more suitably from about 3 wt-% to about 15 wt-% of the blend.

In a specific embodiment, the amine oxide surfactant used is FMB® AO-08, N,N-dimethyl-1-octylamine-N-oxide low foaming surfactant available from Lonza Group headquartered in Switzerland.

The organic or inorganic salts of polycarboxylated alcohol alkoxylates or oxyalkylated linear alcohol carboxylic acid adducts are useful herein. Suitable polycarboxylated alcohol alkoxylate or oxyalkylated linear alcohol carboxylic acid adducts for use herein include, but are not limited to, polycarboxylated linear alcohol alkoxylates, polycarboxylated branched alcohol alkoxylates, polycarboxylated cyclic alcohol alkoxylates, and combinations thereof. The polycarboxylated alcohol alkoxylates are capable of emulsifying oil and sequestering hardness ions.

More specific polycarboxylated alcohol alkoxylates suitable for use herein are those having a backbone containing both poly(propylene oxide) and poly(ethylene oxide) blocks such as POLY-TERGENT® CS-1 surfactant available from BASF.

Any of a wide variety of inorganic or organic bases can be utilized to neutralize at least a portion of the acid groups on the polycarboxylated alcohol alkoxylate to provide the desired salt thereof, such as for example alkali metal hydroxides, alkaline earth metal hydroxides, and metal-free hydroxides, including potassium hydroxide, ammonium hydroxide, calcium hydroxide, magnesium hydroxide, ammonia, mono-, di- and tri-ethanol amines, and combinations thereof. Sodium hydroxide is particularly suitable because of its availability and economics.

The organic or inorganic base is preferably employed in at least an equimolar amount relative to the number of moles of polycarboxylated alcohol alkoxylate used. The polycarboxylated alcohol may also contain a polycarboxylic acid, for example, polyacrylic acid, along with the starting alcohol alkoxylate and esters of the alkoxylate and the said polycarboxylic acid.

The polycarboxylated alcohol alkoxylate is useful from about 1 wt-% to about 30 wt-% of the surfactant blend and more suitably from about 3 wt-% to about to 25 wt-% of the blend.

The alcohol alkoxylates employed in the present invention are suitably selected from a wide range of compounds. These alcohol alkoxylates provide cleaning and degreasing properties, as well as defoaming and wetting characteristics. Alcohol alkoxylates are discussed in U.S. Pat. No. 3,956,401, the entire contents of which are incorporated by reference herein.

The properties of alcohol alkoxylates are defined by the size and shape of the hydrophobic chain as well as the type and number of alkoxylate groups present. Suitably, some particular alcohol alkoxylates suitable for use herein include, but are not limited to, those alkoxylates of $C_6$–$C_{11}$ alcohols including both branched and straight chain alcohols. Suitably, the alkoxylate groups are ethoxylates having from about 2–7 ethyleneoxy ($C_2H_4O$—) groups. $C_3$ and $C_4$ alkoxylates may also be utilized in whole or in part. An example of a particularly useful alcohol alkoxylate is represented by the following general formula:

$$C_nH_{2n+1}O(C_2H_4O)_pH$$

where n is 6–11 and p is 2–7.

One example of a commercially available alcohol alkoxylate suitable for use herein includes, but is not limited to, BEROL® 840, a 2-ethylhexanol ethoxylate nonionic surfactant available from Akzo Nobel.

The alcohol alkoxylate is useful from about 1 wt-% to about 10 wt-% and more suitably from about 3 wt-% to about 6 wt-% of the surfactant blend.

The Surfactant Hydrotrope

The alkyl polysaccharide or polyglucoside functions as a solubilizer or hydrotrope for the other surfactants, in particular, the amine oxide surfactant which can be difficult to solubilize in a highly alkaline environment.

The alkyl polyglucoside surfactants, it is theorized, act to create loosely bound structures with areas of hydrophobicity in the alkaline solutions thereby functioning as a hydrotrope or solubilizer. Alkyl polyglucoside surfactants contain a strongly hydrophobic alkyl group and a strongly hydrophilic glycoside group. Hydrophilicity can be further modified through the presence of ethylene oxide groups. These materials appear to be quite effective concentrated aqueous solution stabilizers when the material is soluble in the aqueous phase and can promote small particle size concentrated aqueous solutions.

Suitable alkyl polyglucosides for use herein have the following formula:

$$RO(C_nH_{2n}O)_y(HEX)_x$$

wherein HEX is derived from a hexose including glucose; R is a hydrophobic typically lipophilic group including alkyl, alkylphenyl, hydroxyalkylphenyl groups, and mixtures thereof in which the alkyl groups contain from about 6 to about 24 carbon atoms; n is 2 or 3; y is about 0 to 10 and x is about 1.5 to 8. More preferred are alkyl polyglucosides wherein the alkyl group has about 6 to about 24 carbon atoms and wherein y is 0 and x is about 1.5 to 4.

More suitably, the hexose is glucose, the alkyl group has about 6 to about 24 carbon atoms, y is 0 and x is about 1.5 to 4. In some preferred embodiments of the present invention, the alkyl polyglucoside has a $C_6$ to $C_{10}$ alkyl group. These compounds contain 1 to 20, preferably 1.1 to 5, glucoside units.

Other suitable polysaccharides or polyglucosides have the following formula:

$$R_2O(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7.

Alkyl polyglucosides and their preparation are discussed in U.S. Pat. No. 5,681,949, and also in U.S. Pat. No. 6,150,290, both of which are incorporated by reference herein in their entirety.

Alkyl polyglucosides having different alkyl groups and DP's are commercially available. An example of a commercially available alkyl polyglucoside is GLUCOPON® 225 CS which has an alkyl hydrophobic group of $C_8$ to $C_{10}$ with a glucose as the hydrophilic group and a DP of 1.7. This material is very soluble in sodium hydroxide. The general class of alkyl polyglucosides produces low interfacial tension between mineral oil and water. Low interfacial tension is probably responsible for the success of these surfactants in stabilizing the concentrated aqueous solution.

The alkyl glucosides are useful from about 10 wt-% to about 50 wt-% in the surfactant blend, and more suitably from about 10 wt-% to about 45 wt-% of the surfactant blend.

In a specific embodiment of the present invention, the alkyl polyglucoside utilized is hexyl polyglucoside which is made from a short chain fatty alcohol and glucose with a DP of 1.8, sold under the tradename of AG® 6206 available from Akzo Nobel, and AG° 6202, a $C_8$ branched chain fatty alcohol also available from Akzo Nobel.

Cleaning Compositions

The surfactant blend of the present invention may be combined with various other optional ingredients including caustic solutions, bleaches, water conditioning agents, and so forth to provide useful cleaning compositions. In particular, the surfactant blend of the present invention finds utility in any formulation where relatively insoluble high performing nonionic surfactants are mixed with caustic solutions to form a concentrated aqueous solution with properties balanced for the selected end use.

The Alkaline Source

A source of alkalinity is needed to control the pH of the use solution. The alkalinity may be provided by any known source. The alkalinity source may be, for instance, an alkali metal hydroxide, such a sodium hydroxide, potassium hydroxide or mixtures thereof; or an alkali metal silicate such as sodium metasilicate; and so forth. A particularly suitable source, due to its availability and its economics, is commercially available sodium hydroxide which can be obtained in aqueous solutions in a concentration of about 50 wt-% and in a variety of solid forms in varying particle sizes. The sodium hydroxide can be employed in the invention in either liquid or solid form or a mixture of both. Other useful sources of alkalinity include, but are not limited to, alkali metal carbonates, alkali metal bicarbonates, alkali metal sesquicarbonates, alkali metal borates, alkali metal silicate, and so forth. The carbonate and borate forms are typically used in place of the alkali metal hydroxide when a lower pH is desired.

Without the alkyl polyglucoside, the surfactant phase is essentially a separate phase and will contain only surfactant. Adding the alkyl polyglucoside allows the surfactant phase to be emulsified into the alkaline phase. A simple mixture of aqueous sodium hydroxide (20 to 50% active) and an amine oxide surfactant without alkyl polyglucoside will form two separate phases. Amine oxide surfactantas have little solubility in a highly alkaline solution. Further, the alkyl polyglucoside provides improved stablity wherein phase separation occurs to little or no extent.

The presence of the alkyl polyglucoside also appears to decrease the particle size and stabilize the aqueous solution.

The alkaline source is useful up to about 50 wt-% in the concentrate.

Water Conditioning Agents

Water conditioners may be added to the compositions of the present invention. The water conditioning, hardness ion chelating or calcium, magnesium, manganese or iron sequestering agents suitable for use in the invention include organic phosphonates, NTA and alkali metal salts thereof, EDTA and alkali metal salts thereof, anionic polyelectrolytes such as polyacrylates and acrylic acid copolymers, itaconic acid copolymers such as an acrylic/itaconic acid copolymer, maleates, sulfonates and their copolymers, alkali metal gluconates. Also suitable chelating agents are organic phosphonates such as 1-hydroxyethylidene-1,1-diphosphonic acid, amino tri(methylene phosphonic acid), hexamethylene diamine tetra(methylene phosphonic acid), diethylene triamine penta(methylene phosphonic acid), and 2-phosphonobutane-1,2,4-tricarboxylic acid and other commercially available organic phosphonates water conditioning agents. Most conventional agents appear to work since they are compatible in either the continuous phase or the droplet phase. The examples that were provided contain a mixture of poly(acrylic acid)and butane(tricarboxylic acid) phosphonic acid as the builder. The latter material contains phosphorus and the whole formulation is considered to be phosphorus formula. Phosphorous containing and phosphorus free formulations have been developed with the alkyl polyglucosides having acceptable cleaning properties. These have properties similar to the examples except that they do not contain phosphorus. The water conditioning agents are useful up to about 10 wt-% in the concentrate, and suitably from about 0.1 wt-% to about 5 wt-%.

Bleach

The concentrates of the present invention can not only be used in highly alkaline solutions, but they can also be used in chlorine containing formulations without significantly lowering the available chlorine. Therefore the concentrates may be used wherever low foaming, high alkaline stable and chlorine stable properties are desired. Therefore, chlorine and oxygen bleaches may be optionally added. Chlorine is typically added in the form of sodium hypochlorite. The compositions may further include up to about 25 wt-% sodium hypochlorite, and more suitably up to about 10 wt-%. The compositions exhibit loss of chlorine at a rate of less than about 10 wt-% over 120 hours or 5 days.

Other Optional Ingredients

Other optional ingredients may be added to the compositions of the present invention in small amounts. Such ingredients are conventional in the art and include, but are not limited to, optical brighteners, soil antiredeposition agents, antifoam agents, other low foaming surfactants, defoaming surfactants, pigments and dyes, thickening/gelling agents, and so forth which are used in these formulas. Such materials can be formulated with the other ingredients or added during cleaning operations.

The compositions of the present invention may be prepared according to any method known in the art. For instance, the nonionic surfactant(s) and alkyl polyglucoside may first be added to an aqueous base including a source of alkalinity, i.e. 50 wt-% active aqueous sodium hydroxide, thus forming an alkaline surfactant blend. The alkaline surfactant blend may then further be combined with water conditioning agent(s) to form an intermediate mixture. This mixture is then exposed to high shear. The other optional ingredients listed above may also be included in this intermediate mixture.

Use Solutions

The present invention contemplates a concentrate composition which is diluted to a use solution prior to use. In a concentrated cleaning composition, the alkyl glucoside is present from about 0.01 wt-% to about 5 wt-%, the amine oxide is present from about 0.01 wt-% to about 5 wt-% and suitably from about 0.03 wt-% to about 2 wt-%, the polycarboxylated alcohol alkoxylate is present from about 0.01 wt-% to about 5 wt-%, and suitably from about 0.03 wt-% to about 3 wt-%, and the alcohol alkoxylate is useful from about 0.01 wt-% to about 1 wt-% and suitably from about 0.04 wt-% to about 5 wt-%. As noted above, the concentrate may further comprise caustics, bleaches, water conditioning agents, and so forth.

Primarily for reasons of economics, the concentrate would normally be marketed and an end user would preferably dilute the concentrate with water or an aqueous diluent to a use solution. The concentrates may be diluted to use concentrations by diluting the concentrate at a ratio of about 1:1 to about 1:10, suitably about 1:6 of the concentrate to water, i.e. 1 gallon of concentrate to 6 gallons of water.

The concentrates may be employed in all types of cleaning compositions including all-purpose cleaners and other formulations including hard surface cleaners, warewashing detergents, laundry, clean-in-place (CIP), and vehicle care reuse cleaning solutions, and so forth by diluting the concentrate with water as described above.

EXAMPLES

TEST METHODS

1. Foam Height

Foam-producing or foam-controlling properties of water-soluble or water-dispersible products are determined using a bench top CIP simulator foam machine. The procedure is as follows. Install the required jet on the stainless steel tubing assembly of the foam machine. Add three liters of water of the required hardness to the foam machine cylinder-stainless steel beaker assembly. The cylinder has an inner diameter of 5.25". Refer to the product specification for specific test instructions. Start the pump (Eastern Stainless Steel Pump, Type 104, Model D-11, ⅕ HP) of the foam machine and adjust the water pressure to 6 psi unless otherwise directed by the product specification. While the pump is running, adjust the water temperature if necessary. Maintain the water level at the three liter mark. Add the test materials and reagents required in the product specification and observe the operating conditions listed in the product specification. Determine and record the test values indicated in the product specification. Read the foam height to the nearest ⅛ inch. If there is a variety of foam heights in the cylinder. Record the average height.

2. Chlorine Stability

The available chlorine is determined by reducing chlorine to chloride by iodide ions. The iodine liberated by this reaction is determined by titration with sodium thiosulfate. Titration may be accomplished either manually with a starch indicator, or potentiometrically with an automatic titrator.

Example 1 and Comparative Examples A and B

A surfactant concentrate having the following composition of the present invention was prepared:

TABLE 1

| | | |
|---|---|---|
| AG ® 6206 (75% active) | hexyl polyglucoside | 17.00 (wt-%) |
| FMB ® AO-8 (41% active) | N,N-dimethyl-1-ocytylamine-N-oxide | 28 |
| POLYTERGENT ® CS-1 (50% active) | polycarboxylated alcohol ethoxylate | 50 |
| BEROL ® 840 (100% active) | 2-ethylhexanol ethoxylate | 5 |

*The above resultant surfactant blend has 45.75 wt-% water; 12.75 wt-% $C_6$ alkyl polyglucoside; 11.50 wt-% $C_8$ amine oxide; 25.00 wt-% polycarboxylated alcohol ethoxylate; and 5.00 wt-% $C_6$ alcohol ethoxylate.

The above surfactant blend was then formulated into a cleaning composition as shown in Example 1 found in Table 2 below. Comparative example A illustrates a standard composition and comparative example B illustrates a composition having some, but not all the surfactants according to the surfactant blend of the present invention.

TABLE 2

| | Ex 1 (wt-%) | A (wt-%) | B (wt-%) |
|---|---|---|---|
| Sodium hydroxide | 34.00 | 34.00 | 34.00 |
| Potassium hydroxide | 5.74 | 5.74 | 5.74 |
| AG ® 6206 hexyl polyglucoside | 0.26 | — | 0.30 |
| FMB ® AO-8 amine oxide surfactant | 0.23 | — | — |
| POLY-TERGENT ® CS-1 polycarboxylated alcohol ethoxylate | 0.50 | — | 0.74 |
| BEROL ® 840 2-ethylhexanol ethoxylate | 0.10 | — | — |
| RHODATERGE ® BCC** wetting/antifoaming agent (42.5% active) | — | 1.00 | — |
| *water-conditioning agent | 0.15 | 0.15 | 0.15 |
| water | 58.45 | 59.68 | 59.07 |

*The water conditioning agent includes:
57.14 wt-% sodium salt of polyacrylic acid
21.43 wt-% sodium salt of 2-phosphono-1,2,3-butane tricarboxylic acid
21.43 wt-% sodium salt of poly(acrylic acid co-hypophosphite)
**RHODATERGE ® BCC is a commercially available blend of amphoteric surfactants.

Example 1 was also tested for its effect on the surface tension of a 38% caustic solution as compared to examples A and B. The results are shown in FIG. 1. Example 1 has a greater effect on the surface tension than either comparative A or B.

Examples 1–7 and Comparative Examples C–K

The following compositions were prepared and tested for stability. Table 1 exhibits formulas 1–7 of the present invention, while table 4 exhibits comparative examples C–G.

While examples 1–7 exhibited good stability, comparatives examples C–G did not. The compositions were visually observed for precipitation and phase separation at ambient temperatures over a 5 day period.

TABLE 3

| | 1 | 2 | 3 | 4 | 5 | 6 | 7 |
|---|---|---|---|---|---|---|---|
| POLYTERGENT ® CS-1 polycarboxylated alcohol ethoxylate | 0.50 | 0.09 | 0.50 | 0.50 | 0.50 | 0.50 | 0.50 |
| AG ® 6206 hexyl polyglucoside | 0.29 | 0.84 | 0.50 | 0.39 | 0.38 | 0.32 | 0.26 |
| FMB ® AO-8 amine oxide | 0.20 | 0.07 | 0.09 | 0.09 | 0.10 | 0.16 | 0.23 |
| BEROL ® 840 2-ethylhexanol ethoxylate | 0.10 | 0.08 | 0.12 | 0.10 | 0.10 | 0.10 | 0.10 |
| Sodium hydroxide | 34.00 | 34.00 | 34.00 | 34.00 | 34.00 | 34.00 | 34.00 |
| Potassium hydroxide | 5.74 | 5.74 | 5.74 | 5.74 | 5.74 | 5.74 | 5.74 |
| *water-conditioning agent | 0.15 | 0.15 | 0.15 | 0.15 | 0.15 | 0.15 | 0.15 |
| soft water | 59.03 | 59.03 | 58.90 | 59.03 | 59.03 | 59.03 | 59.02 |
| comments | stable | stable | stable | stable | stable | stable | stable |

In example 1–7 shown in Table 3 above, the amount of the amine oxide surfactant in example 7 has been maximized therefore the improved performance.

TABLE 4

| | C | D | E | F | G | H | I | J |
|---|---|---|---|---|---|---|---|---|
| polycarboxylated alcohol ethoxylate | 1.00 | 0.23 | — | — | — | — | — | — |
| hexyl polyglucoside | — | 0.84 | — | 0.78 | 0.80 | 0.84 | 0.84 | 0.84 |
| amine oxide | — | — | 0.82 | 0.25 | 0.22 | 0.18 | 0.16 | — |
| 2-ethylhexanol ethoxylate | — | — | — | — | — | — | 0.12 | 0.28 |
| Sodium hydroxide | 34.00 | 34.00 | 34.00 | 34.00 | 34.00 | 34.00 | 34.00 | 34.00 |
| Potassium hydroxide | 5.74 | 5.74 | 5.74 | 5.74 | 5.74 | 5.74 | 5.74 | 5.74 |
| *water-conditioning agent | 0.15 | 0.15 | 0.15 | 0.15 | 0.15 | 0.15 | 0.15 | 0.15 |
| soft water | 59.11 | 59.04 | 59.29 | 59.08 | 59.09 | 59.09 | 58.99 | 58.99 |
| comments | unstable | stable | unstable | unstable | unstable | stable | stable | stable |

The water conditioning agent includes:

57.14 wt-% sodium salt of polyacrylic acid 21.43 wt-% sodium salt of 2-phosphono-1,2,3-butane tricarboxylic acid 5 21.43 wt-% sodium salt of poly(acrylic acid co-hypophosphite), sodium salt While comparative example D,H,I, and J were found to be stable, those lacking the polycarboxylated alcohol ethoxylate exhibited decreased effectiveness in cleaning, and those compositions without the alcohol alkoxylate exhibited less reduction in surface tension.

Comparative example K, an industry standard composition, was also prepared and compared for stability to examples 1–7. Comparative example K has the following composition.

Example 8 and Comparative Examples I–K

The surfactant blend of the present invention was formulated into a bleach-containing product and tested against various comparative examples for chlorine stability over a 5 day period according to the test method described above. The compositions and chlorine stability results are found in the following table 4. Chlorine stability is reported as a percentage of the initial chlorine concentration that is lost.

TABLE 4

| | Example 8 | I | J | K |
|---|---|---|---|---|
| Sodium hydroxide | 6.60 | 6.60 | 6.60 | 6.60 |
| Potassium hydroxide | 1.11 | 1.11 | 1.11 | 1.11 |
| $C_8$ amine oxide (FMB AO-8) | 0.13 | — | 0.11 | 0.10 |
| hexyl polyglucoside (AG ® 6206) | 0.19 | — | 0.55 | 0.55 |
| 2-ethylhexanol ethoxylate (BEROL ® 840) | 0.07 | — | — | 0.08 |
| polycarboxylated alcohol ethoxylate (POLYTERGENT ® CS-1) | 0.33 | — | — | — |
| **RHODATERGE ® BCC | — | 0.28 | — | — |
| Water conditioning agent | 3.50 | 3.50 | 3.50 | 3.50 |
| Sodium hypochlorite | 1.50 | 1.50 | 1.50 | 1.50 |
| Soft water | 86.57 | 87.01 | 86.63 | 86.56 |
| Chlorine Loss over 5 days | 7.4% | 7.7% | 22.0% | 27% |

**RHODATERGE ® BCC is a commercially available blend of amphoteric surfactants.

The water conditioning agent includes:

57.14 wt-% sodium salt of polyacrylic acid 21.43 wt-% sodium salt of 2-phosphono-1,2,3-butane tricarboxylic acid 21.43 wt-% sodium salt of poly(acrylic acid co-hypophosphite), sodium salt Example 8 exhibits comparable chlorine stability to comparative example I, a standard cleaning composition and greatly improved chlorine stability over comparative examples J and K which have some, but not all, of the surfactants found in the surfactant blend according to the present invention. Desirably, chlorine loss is 20% or less over a 5 day period. While example 1 and comparative example I are acceptable, comparative examples J and K are not.

What is claimed is:

1. A low foaming surfactant blend for use in highly alkaline conditions, comprising:

a) about 10 to about 50 wt-% of at least one alkyl polyglucoside;

b) about 1 to about 15 wt-% of at least one amine oxide;

c) about 1 to about 30 wt-% of at least one polycarboxylated alcohol alkoxylate;

d) about 1 to about 10 wt-% of at least one alcohol alkoxylate; and e) 0 wt-% to about 25 wt-% water.

2. The surfactant blend of claim 1 further comprising water.

3. The surfactant blend of claim 1, comprising:

a) about 10 wt-% to about 45 wt-% of said at least one alkyl polyglucoside;

b) about 3 wt-% to about 15 wt-% of said at least one amine oxide;

c) about 3 wt-% to about 25 wt-% of at least one polycarboxylated alcohol alkoxylate; and d) about 3 wt-% to about 6 wt-% of said at least one alcohol ethoxylate.

4. A cleaning composition comprising the surfactant blend of claim 1 and a source of alkalinity.

5. The cleaning composition of claim 4 wherein said source of alkalinity is an alkali metal hydroxide or an alkali metal silicate.

6. The cleaning composition of claim 5 wherein said source of alkalinity is potassium hydroxide, sodium hydroxide, or a mixture thereof.

7. The cleaning composition of claim 4 wherein said source of alkalinity comprises a solution of sodium hydroxide which is about 25% to about 50% active.

8. The surfactant blend of claim 1 wherein said alkyl polyglucoside is a $C_6$ to $C_8$ alkyl polyglucoside.

9. The surfactant blend of claim 1 wherein said alkyl polyglucoside is hexyl polyglucoside.

10. The surfactant blend of claim 1 wherein said amine oxide is a $C_{10}$ to $C_{18}$ alkyl dimethylamine oxide or acylamido alkyl dimethylamine oxide.

11. The surfactant blend of claim 1 wherein said polycarboxylated alcohol alkoxylate is selected from the group consisting of polycarboxylated linear alcohol alkoxylates, polycarboxylated branched alcohol alkoxylates, polycarboxylated cyclic alcohol alkoxylates, and combinations thereof.

12. The surfactant blend of claim 1 wherein said alcohol ethoxylate is 2-ethyl hexanol ethoxylate.

13. The surfactant blend of claim 1 further comprising at least one selected from silicates, glycol ethers, water conditioning agents, a source of chlorine, high foam amine oxides, and mixtures thereof.

14. A cleaning composition comprising the surfactant blend of claim 1 and an effective water conditioning or sequestering amount comprising about 0.1 to about 20 wt % of a water conditioning or sequestering agent.

15. A cleaning composition comprising the surfactant blend of claim 1 and about 5 wt-% to about 20 wt-% sodium hypochlorite.

16. The cleaning composition of claim 15 wherein said surfactant blend loses less than about 10% chlorine over 5 days.

17. A method of preparing a low foaming highly alkaline detergent comprising the steps of:

I. combining the surfactant blend of claim 1 in an aqueous base comprising up to about 50 wt-% active aqueous sodium hydroxide to form an alkaline surfactant blend; and II. mixing said surfactant blend.

18. A low foaming highly alkaline surfactant concentrate useful in detergent solutions, comprising:

i) a surfactant blend, comprising:
   a) about 10 to about 50 wt-% of the blend of at least one alkyl polyglucoside;
   b) about 1 to about 15 wt-% of the blend of at least one amine oxide;
   c) about 3 to about 30 wt-% of the blend of at least one polycarboxylated alcohol alkoxylate;
   d) about 3 to about 6 wt-% of the blend of at least one alcohol alkoxylate; and ii) an aqueous solution of about 25% to about 50% active alkali metal hydroxide.

19. The concentrate of claim 18 diluted with water to a use dilution of about 1:10 to 1:100 of the concentrate to water.

20. The concentrate of claim 18 further comprising sodium hypochlorite.

21. The concentrate of claim 18 further comprising water conditioning agents.

22. The concentrate of claim 18 comprising:

a) about 10 to about 45 wt-% of said at least one alkyl polyglucoside;

b) about 3 to about 15 wt-% of said at least one amine oxide;

c) about 3 to about 25 wt-% of said at least one polycarboxylated alcohol alkoxylate; and d) about 3 to about 6 wt-% of said at least one alcohol alkoxylate.

23. The surfactant blend of claim 1 wherein said alcohol alkoxylate is an alcohol ethoxylate.

24. The surfactant blend of claim 1 wherein said alcohol alkoxylate is a $C_3$ to $C_{10}$ alcohol alkoxylate.

25. The surfactant blend of claim 1 wherein said alkyl polyglucoside is a $C_6$ to $C_{24}$ alkyl polyglucoside.

26. The surfactant blend of claim 1 employed in a diluted use composition wherein said composition is diluted at a ratio of about 1:10 to 1:100 with water.

27. The surfactant blend of claim 1 employed in a diluted use composition wherein said composition is diluted at a ratio of about 1:30 with water.

28. A cleaning composition comprising:

a) about 0.01 to about 5 wt-% of at least one alkyl glucoside;

b) about 0.01 wt-% to about 5 wt-% of at least one amine oxide;

c) about 0.01 wt-% to about 5 wt-% of at least one polycarboxylated alcohol; and d) about 0.01 wt-% to about 5 wt-% of at least one alcohol alkoxylate.

29. The surfactant blend of claim 28 employed in a diluted use composition wherein said composition is diluted at a ratio of about 1:1 to about 1:10 with water.

30. The surfactant blend of claim 28 employed in a diluted use composition wherein said composition is diluted at a ratio of about 1:6 with water.

31. The composition of claim 30 wherein said at least one amine oxide is present at a concentration of about 0.03 wt-% to about 2 wt-%.

32. The composition of claim 30 wherein said at least one polycarboxylated alcohol alkoxylate is present at a concentration of about 0.03 wt-% to about 3 wt-%.

33. The composition of claim 30 wherein said at least one alcohol alkoxylate is present at a concentration of about 0.04 wt-% to about 3 wt-%,.

34. The composition of claim 30 further comprising at least one member selected from the group consisting of caustics, bleaches, water conditioning agents, silicates, solvents, high foam amine oxides, and mixtures thereof.

35. A low foaming surfactant blend for use in highly alkaline conditions, comprising:

a) about 1 part by weight of at least one alkyl polyglucoside;

b) about 0.02 to about 1.5 part by weight of at least one amine oxide;

c) about 0.02 to about 3.0 parts by weight of said at least one polycarboxylated alcohol alkoxylate; and d) about 0.02 to about 1 part by weight of at least one alcohol alkoxylate.

* * * * *